US011124000B2

(12) United States Patent
Arakawa et al.

(10) Patent No.: US 11,124,000 B2
(45) Date of Patent: Sep. 21, 2021

(54) IMAGE RECORDING APPARATUS

(71) Applicant: Brother Kogyo Kabushiki Kaisha, Nagoya (JP)

(72) Inventors: Yuta Arakawa, Nagoya (JP); Yoichiro Nishimura, Kitakyushu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/750,671

(22) Filed: Jan. 23, 2020

(65) Prior Publication Data

US 2020/0238739 A1 Jul. 30, 2020

(30) Foreign Application Priority Data

Jan. 28, 2019 (JP) ..... JP2019-012315

(51) Int. Cl.
*B41J 23/00* (2006.01)
*B41J 25/00* (2006.01)

(52) U.S. Cl.
CPC ..... *B41J 25/006* (2013.01)

(58) Field of Classification Search
None
See application file for complete search history.

(56) References Cited

U.S. PATENT DOCUMENTS 8,348,381 B2 1/2013 Nakano et al.
8,451,492 B2 5/2013 Hoshino
9,327,533 B2 5/2016 Wakakusa et al.
2010/0157328 A1 6/2010 Hoshino
2010/0253723 A1 10/2010 Nakano et al.
2016/0089915 A1* 3/2016 Wakakusa ..... B41J 23/025 347/37
2017/0246890 A1* 8/2017 Oguchi ..... B41J 25/001

FOREIGN PATENT DOCUMENTS

JP 2010-046963 A 3/2010
JP 2010-241011 A 10/2010
JP 2016-064578 A 4/2016

* cited by examiner

*Primary Examiner* — Erica S Lin
*Assistant Examiner* — Tracey M McMillion
(74) *Attorney, Agent, or Firm* — Banner & Witcoff, Ltd.

(57) ABSTRACT

A slide member slides in conjunction with reciprocation of a carriage. The slide member slides between a first position and a second position to cause a switch gear to move between a plurality of slide positions at which the switch gear engages respective ones of a plurality of transmission gears. The slide member at the second position is closer to a first end of a shaft than the slide member at the first position is. A first cover covers a first sliding contact portion of the shaft over an entire range of the first sliding contact portion in a main scanning direction. The slide member is in sliding contact with the first sliding contact portion when the slide member slides between the first position and the second position. The first sliding contact portion is closer to the first end than the slide member located at the first position is.

15 Claims, 10 Drawing Sheets

IMAGE RECORDING APPARATUS

CROSS REFERENCE TO RELATED APPLICATIONS

This application claims priority from Japanese Patent Application No. 2019-012315 filed Jan. 28, 2019. The entire content of the priority application is incorporated herein by reference.

TECHNICAL FIELD

This disclosure relates to an image recording apparatus.

BACKGROUND

As an image recording apparatus, a known inkjet printer has a plurality of mechanisms such as a feeding mechanism, a conveyance mechanism, and a cleaning mechanism that are driven by a single motor. For example, it is disclosed that an apparatus switches the driving force transmitted from a motor to a plurality of mechanisms by sliding a switch gear.

Specifically, the apparatus includes a driving transmission switch mechanism which includes a shaft integrally and slidably supporting a switch gear and a slide member having a lever arm, wherein the slide member and the switch gear slide when the lever arm is pushed by the movement of a carriage. Within the range for the switch gear to slide, a plurality of transmission gears which engage respective mechanisms are aligned at intervals. The switch gear slides and engages a particular transmission gear to selectively drive these mechanisms.

By using such a driving transmission switch mechanism, mechanisms to be driven can be mechanically switched simply by controlling the movement of the carriage. In other words, the apparatus does not require any additional driving source for switching the mechanisms, thereby realizing a simple structure.

SUMMARY

According to one aspect, this specification discloses an image recording apparatus. The image recording apparatus includes a carriage supporting a recording head, a motor, and a driving transmission switch mechanism. The carriage is configured to reciprocate in a main scanning direction. The driving transmission switch mechanism is configured to switch between a plurality of drive targets and to selectively transmit driving force of the motor to one of the plurality of drive targets. The driving transmission switch mechanism includes a frame, a shaft, a switch gear, a plurality of transmission gears, a slide member, and a first cover. The shaft is supported by the frame and extends in the main scanning direction. The shaft has a first end and a second end opposite the first end in the main scanning direction. The switch gear is slidably supported by the shaft and is configured to rotate by receiving driving force of the motor. The plurality of transmission gears is arranged at positions in the main scanning direction corresponding to a plurality of slide positions of the switch gear. Each of the plurality of transmission gears is configured to engage the switch gear and to transmit the driving force to a corresponding one of the plurality of drive targets. The slide member includes a lever arm protruding to a movement region of the carriage. The slide member is slidably supported by the shaft. The slide member is closer to the first end than the switch gear is. The slide member is configured to slide in conjunction with reciprocation of the carriage. The slide member is configured to slide between a first position and a second position to cause the switch gear to move between the plurality of slide positions at which the switch gear engages respective ones of the plurality of transmission gears. The slide member located at the second position is closer to the first end than the slide member located at the first position is. The first cover is configured to cover a first sliding contact portion of the shaft over an entire range of the first sliding contact portion in the main scanning direction. The slide member is in sliding contact with the first sliding contact portion when the slide member slides between the first position and the second position. The first sliding contact portion is closer to the first end than the slide member located at the first position is.

BRIEF DESCRIPTION OF THE DRAWINGS

Embodiments in accordance with this disclosure will be described in detail with reference to the following figures wherein.

DETAILED DESCRIPTION

The image recording apparatus is sometimes used outdoor so that foreign matters like dust enter the apparatus. When the image recording apparatus having the above-mentioned driving transmission switch mechanism is used in such circumstances, the foreign matters which entered the apparatus adhere to the exposed part of the shaft. Particularly, the sliding contact portion between the switch gear of the shaft and the slide member is the area where lubricant is applied, thereby foreign matters easily adhere to the area. The foreign matters adhering to the sliding contact portion make the sliding friction larger, which can cause problems such as heat generation by switching malfunction and by an increase in load on the motor.

In view of the foregoing, an example of an object of this disclosure is to provide an image recording apparatus configured to suppress adhesion of foreign matters to a shaft supporting a switch gear and a slide member of a driving transmission switch mechanism.

Figure 1:
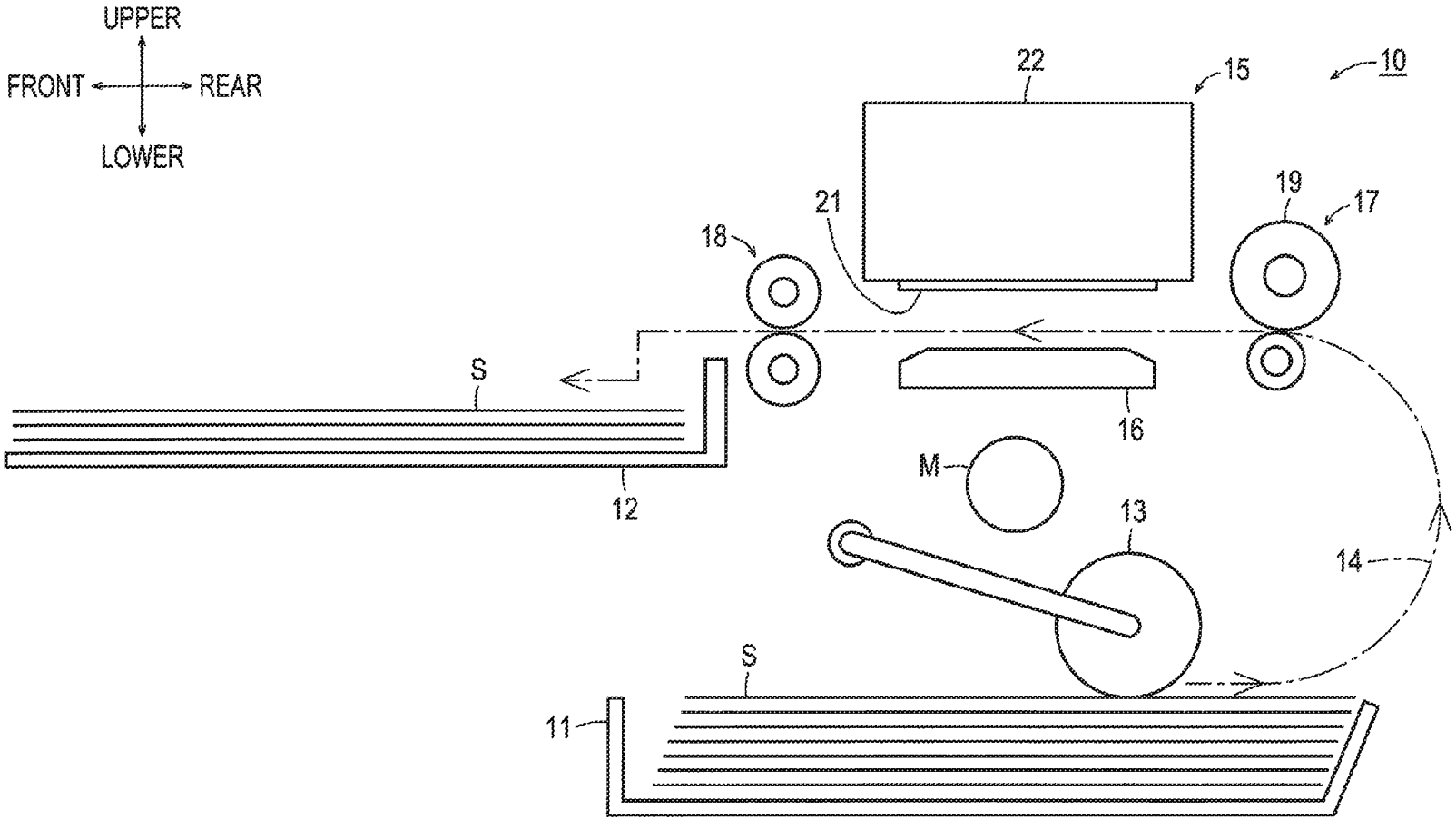
FIG. 1 is a schematic cross-sectional view of a printer according to an embodiment.

Hereinafter, as shown in FIG. 1, in an orientation in which a printer 10 is placed to be usable, the side where a feed tray 11 is pulled out is the front, the opposite side is the rear, and a left-right direction and an upper-lower direction are defined by viewing the printer 10 from the front.

[Schematic Configuration of the Printer]

A printer 10 shown in FIG. 1 (an example of an image recording apparatus) is connected to an external information device and records an image and a document on a sheet S based on print data including image data and document data transmitted from the external information device. The printer 10 also records on a sheet S images and documents stored in a storage medium such as a memory card when the storage medium is inserted into the printer 10.

The printer 10 has the feed tray 11 and a discharge tray 12 arranged at upper and lower two stages. The feed tray 11 is located underneath the discharge tray 12 and stores the sheet S. The sheet S stored in the feed tray 11 is conveyed by a feed roller 13 to a conveyance path 14 and is recorded thereon a desired image by a recording section 15, then the sheet S is discharged to the discharge tray 12.

The conveyance path 14 extends upward from the rear end of the feed tray 11, turns toward the front side, and extends to the discharge tray 12 through the recording section 15. In other words, the sheet S stored in the feed tray 11 is guided to the recording section 15 by the conveyance path 14 in an upward U-turn manner; after recording of the image has been completed by the recording section 15, the sheet S is discharged to the discharge tray 12.

The recording section 15 is located downstream of the bending part of the conveyance path 14 in a conveyance direction. The recording section 15 has a reciprocating carriage 22 with a recording head 21 mounted thereon. The recording head 21 is supplied with ink of four colors of cyan (C), magenta (M), yellow (Y), and black (Bk), through ink tubes 20 (see FIG. 2) from respective ink cartridges independently arranged from the recording head 21 in the printer 10. During the reciprocation of the carriage 22, fine droplets of ink of each color are ejected selectively from the recording head 21 to perform image recording on the sheet S conveyed over a platen 16.

Pairs of conveyance rollers 17, 18 are arranged at an upstream side and a downstream side of the recording section 15. The pairs of conveyance rollers 17, 18 nippingly convey the sheet S that is being conveyed through the conveyance path 14. One of each pair of conveyance rollers 17, 18 rotates by receiving output of the motor M. The other one of each pair of conveyance rollers 17, 18 rotates by following the roller to which the output of the motor M is transmitted.

[Recording Section]

Figure 2:
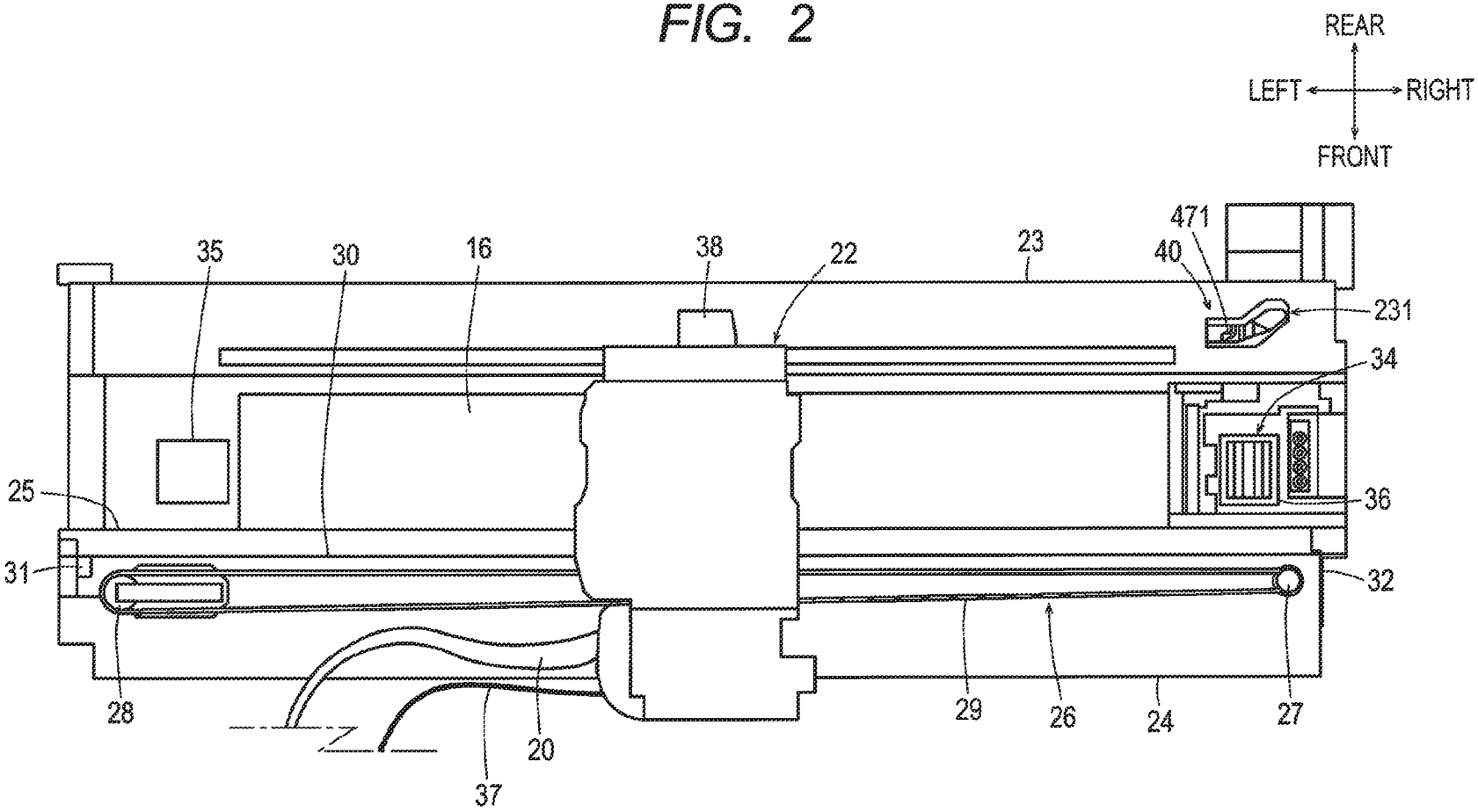
FIG. 2 is a plan view showing the configuration of a recording section.

As shown in FIG. 2, a pair of guide rails 23, 24 are arranged at a particular distance in the conveyance direction of the sheet S (the direction from the rear side toward the front side in FIG. 2) over the conveyance path 14 and extend in a main scanning direction (that is, the left-right direction in FIG. 2) perpendicular to the conveyance direction of the sheet S. The guide rails 23, 24 are placed in the housing of the printer 10 and form a part of the frame supporting each unit of the printer 10. The carriage 22 is mounted thereon across the guide rails 23, 24, which enables the carriage 22 to slide on the guide rails 23, 24 in the main scanning direction. The main scanning direction includes the rightward direction as an example of a first direction and the leftward direction as an example of a second direction. The direction perpendicular to the main scanning direction is referred to as a sub-scanning direction. The sub-scanning direction in this embodiment is the front-rear direction.

The guiderail 23 arranged at the upstream side in the sheet conveyance direction is a plate longer than the reciprocating range of the carriage 22 in the width direction of the conveyance path 14 (that is, the left-right direction in FIG. 2). The guiderail 24 arranged at the downstream side in the sheet conveyance direction is a plate substantially as long as that of the length of the guiderail 23 in the width direction of the conveyance path 14. An upstream-side end of the carriage 22 in the conveyance direction is mounted on the guiderail 23 and a downstream-side end of the carriage 22 in the conveyance direction is mounted on the guiderail 24, which enables the carriage 22 to slide along the longitudinal direction of the guide rails 23, 24.

An edge 25 of the guide rail 24 at the upstream-side in the conveyance direction is bent substantially at right angle upward. The carriage 22 supported by the guide rails 23, 24, slidably sandwiches the edge 25 by using a holding member such as a pair of rollers. With this configuration, the carriage 22 is positioned with respect to the sheet conveyance direction, and the carriage 22 slides in the main scanning direction.

A belt driving mechanism 26 is arranged on the upper surface of the guide rail 24. The belt driving mechanism 26 is configured such that an endless belt 29 having teeth inside is stretched to be laid between a drive pulley 27 and a follow pulley 28, respectively provided at each end of the conveyance path 14 in the width direction. A driving force is input from a motor M to the shaft of the driving pulley 27, and rotation of the drive pulley 27 causes the endless belt 29 to circulate. The belt 29 is not necessarily limited to the above-mentioned endless belt, it may be a belt having ends both of which are fixed to the carriage 22.

The carriage 22 is fixed to the belt 29 at its bottom side. With this configuration, when the belt 29 circulates by the motor M, the carriage 22 reciprocates on the guide rails 23, 24, in the main scanning direction while the edge 25 is used as a point of reference. The recording head 21 is mounted on the carriage 22 and reciprocates in the main scanning direction.

The guide rail 24 is provided with an encoder strip 30 of a linear encoder. The encoder strip 30 is a strip made of a transparent resin. A pair of support portions 31, 32 is provided to stand from the surface of both ends of the guide rail 24 in the width direction (main scanning direction). The encoder strip 30 engages the support portions 31, 32 at both ends thereof and is bridged along the edge 25.

The encoder strip 30 has a pattern in which a transparent part and a light-blocking part are arranged alternately in the longitudinal direction at an equal interval. An optical sensor of a transmission type (not shown) is provided at a position in the upper surface of carriage 22 corresponding to the encoder strip 30. The optical sensor reciprocates with the carriage 22 along the longitudinal direction of the encoder strip 30 and detects the pattern of the encoder strip 30 during the reciprocating movement.

The recording head 21 is provided with a head control board to control the ejection of the ink. The head control board outputs a pulse signal based on the detection signal from the optical sensor. Based on the pulse signal, the location of the carriage 22 is detected, thereby the rotation driving of the motor M is controlled. In FIG. 2, the head control board mounted on the carriage 22 is covered so that the head control board is not shown.

As shown in FIGS. 1 and 2, the platen 16 is provided underneath the conveyance path 14 to face the recording head 21. The platen 16 is disposed at the center of the reciprocating range of the carriage 22 through which the sheet S passes. The platen 16 is wider than the maximum width of the conveyable sheet S, so both ends in the width direction of the sheet S conveyed through the conveyance path 14 always passes over the platen 16.

As shown in FIG. 2, one end of the platen 16 in the width direction is provided with a purge mechanism 34, the other end of the same is provided with a waste ink tray 35. The purge mechanism 34 sucks and removes air bubbles and foreign matters from the nozzles of the recording head 21. The purge mechanism 34 has a cap 36 for covering the nozzles of the recording head 21. The cap 36 moves up and down by a known lift-up mechanism to be attached to and detached from the recording head 21.

The purge mechanism 34 further has a suction pump (not shown in FIG. 2). The suction pump is connected to the cap 36. By operating the suction pump, a negative pressure is generated inside the cap 36. When the suction pump is operated under a condition that the cap 36 is in contact with the recording head 21 and covers the nozzles and an air discharge port respectively, the air bubbles and foreign matters can be sucked and removed.

The waste ink tray 35 receives the so-called flushing, that is, idle ejection of ink from the recording head 21. A felt is disposed to lie inside the waste ink tray 35 as an ink absorber, the flushed ink is absorbed and held within the felt. With the purge mechanism 34 and the waste ink tray 35 used in this way, maintenance inside the recording head 21 is performed, such as removal of the air bubbles and mixed ink and drying prevention.

Although not shown in each Figure, the printer 10 has a cartridge mount section for mounting cartridges that store various colors of ink. A plurality of ink tubes 20 corresponding to each color ink communicates from the cartridge mount section to the carriage 22. Each color ink is supplied from the ink cartridge mounted on the cartridge mount section to the recording head 21 mounted on the carriage 22 through each of the ink tubes 20. The ink tube 20 is a tube made of synthetic resin having flexibility capable of following reciprocating movement of the carriage 22.

Recording signals and so on are transmitted from a main board of the controller (not shown) to the head control board of the recording head 21 through a flat cable 37. The main board is provided at the front side of the apparatus so that the main board is not shown in FIG. 2.

[Driving Transmission Switch Mechanism]

Hereinafter, described is a driving transmission switch mechanism 40 for selectively transmitting a driving force from the motor M to each drive target of the feed roller 13 and the purge mechanism 34. The driving transmission switch mechanism 40 is disposed at the right side of a frame including the guide rails 23, 24, and selectively switches each drive target of the feed roller 13 and the purge mechanism 34 and transmits the driving force.

Figure 3:
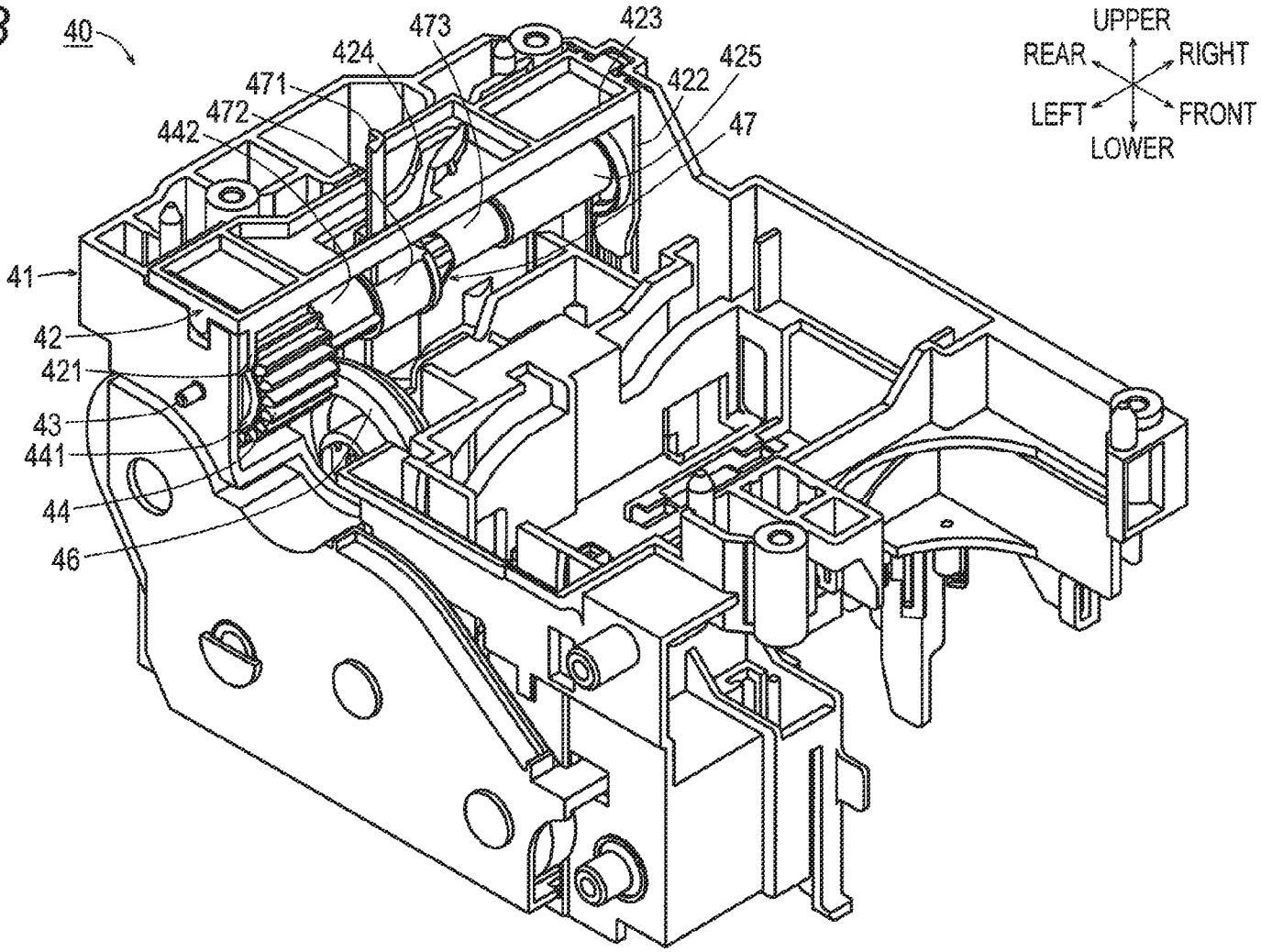
FIG. 3 is a perspective view of a driving transmission switch mechanism.
Figure 4:
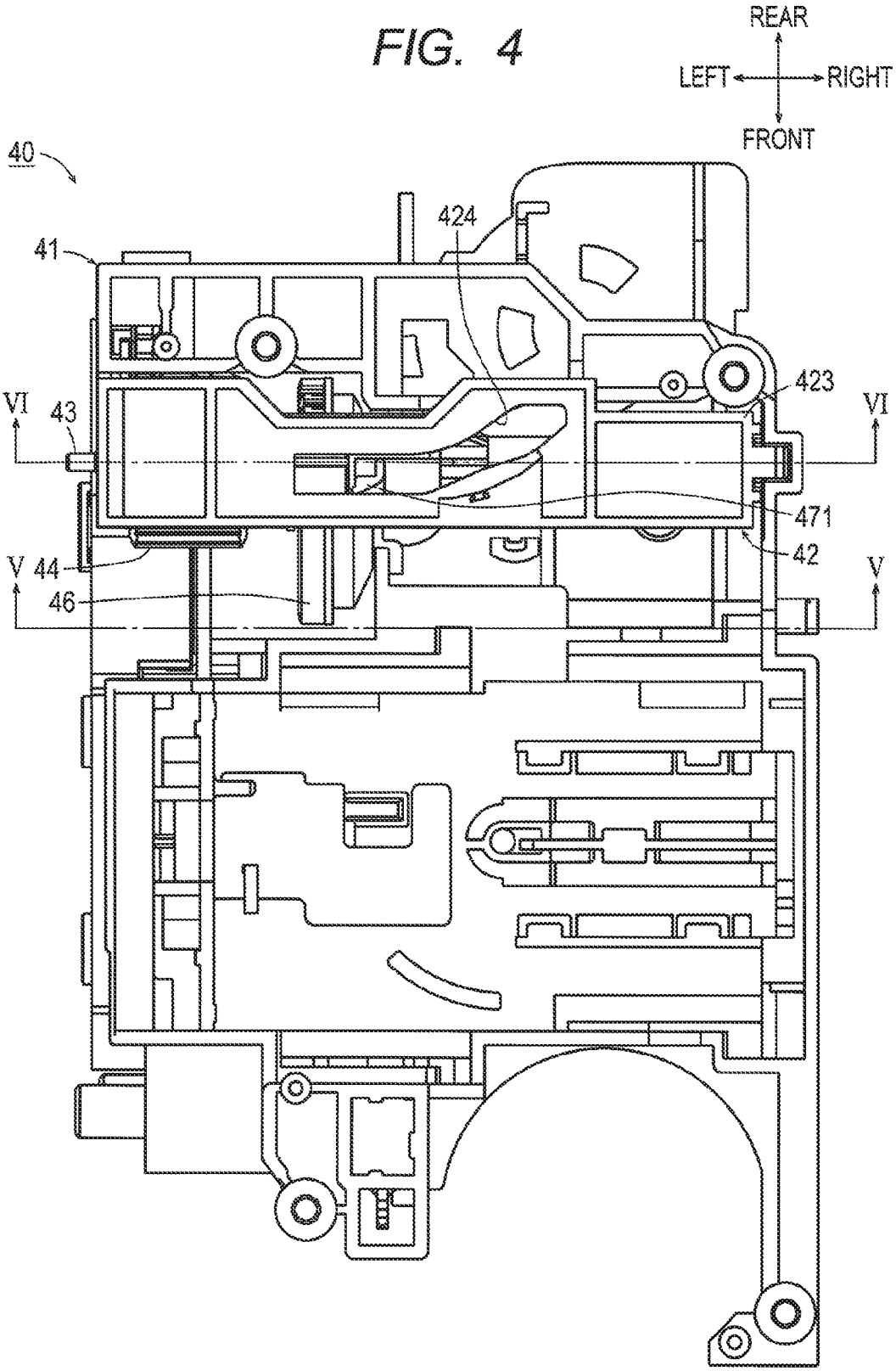
FIG. 4 is a plan view of the driving transmission switch mechanism in a state where a slide member is located at a first position.

As shown in FIG. 3, the driving transmission switch mechanism 40 includes a frame 41 supporting each member of the driving transmission switch mechanism 40, a frame 42 supporting a shaft 43, and the shaft 43 supported by the frame 42 and extending in the main scanning direction. The driving transmission switch mechanism 40 further includes a switch gear 44 slidably supported by the shaft 43 and configured to rotate by the driving force of the motor M. The shaft 43 has a left end 43L and a right end 43R.

The driving transmission switch mechanism 40 includes two transmission gears 45, 46 (refer to FIG. 6) arranged in the main scanning direction so as to correspond to the slide positions of the switch gear 44, the two transmission gears 45, 46 being configured to engage the switch gear 44 and for transmitting the driving force to each drive target.

Figure 5:
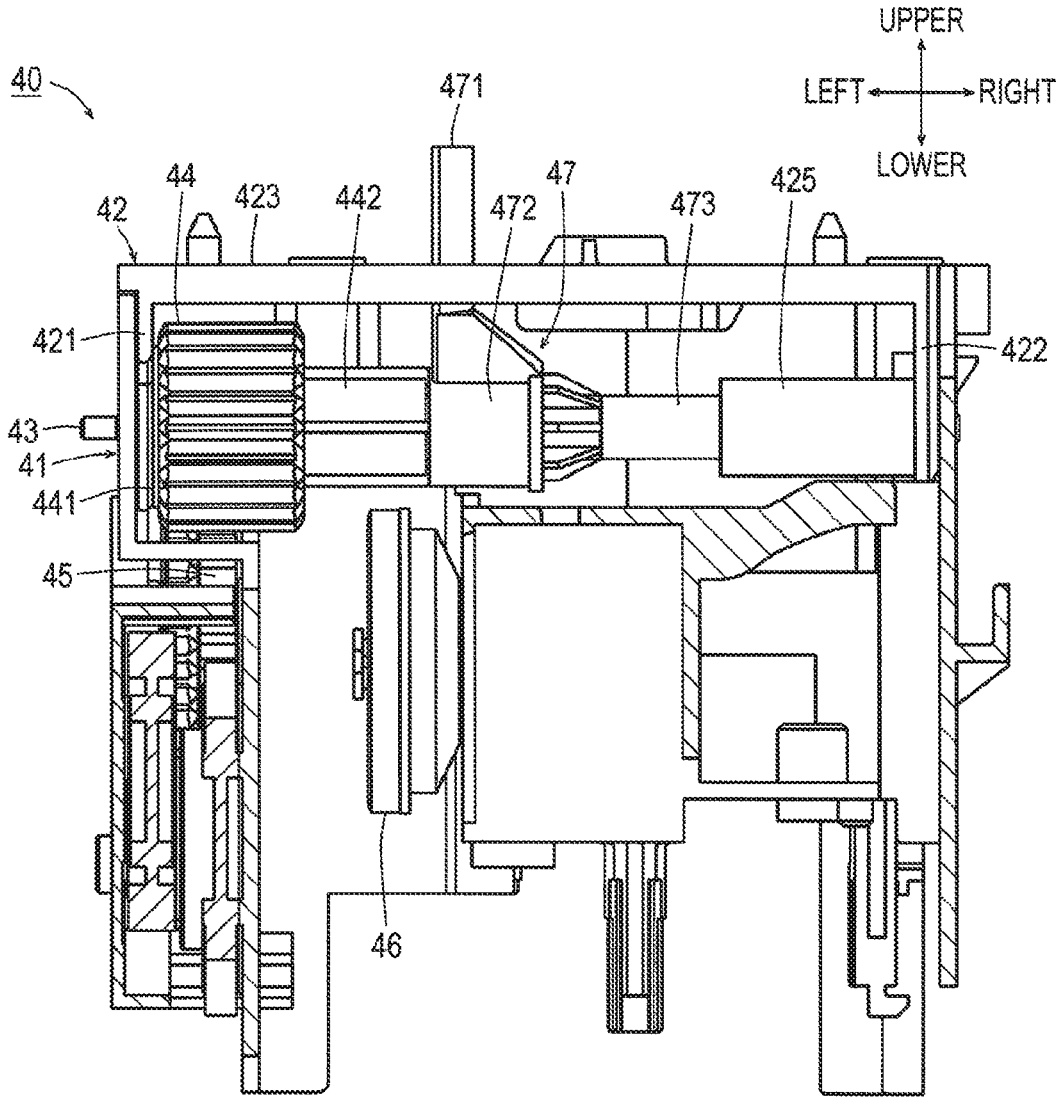
FIG. 5 is a cross-sectional view taken along line V-V in FIG. 4.
Figure 8:
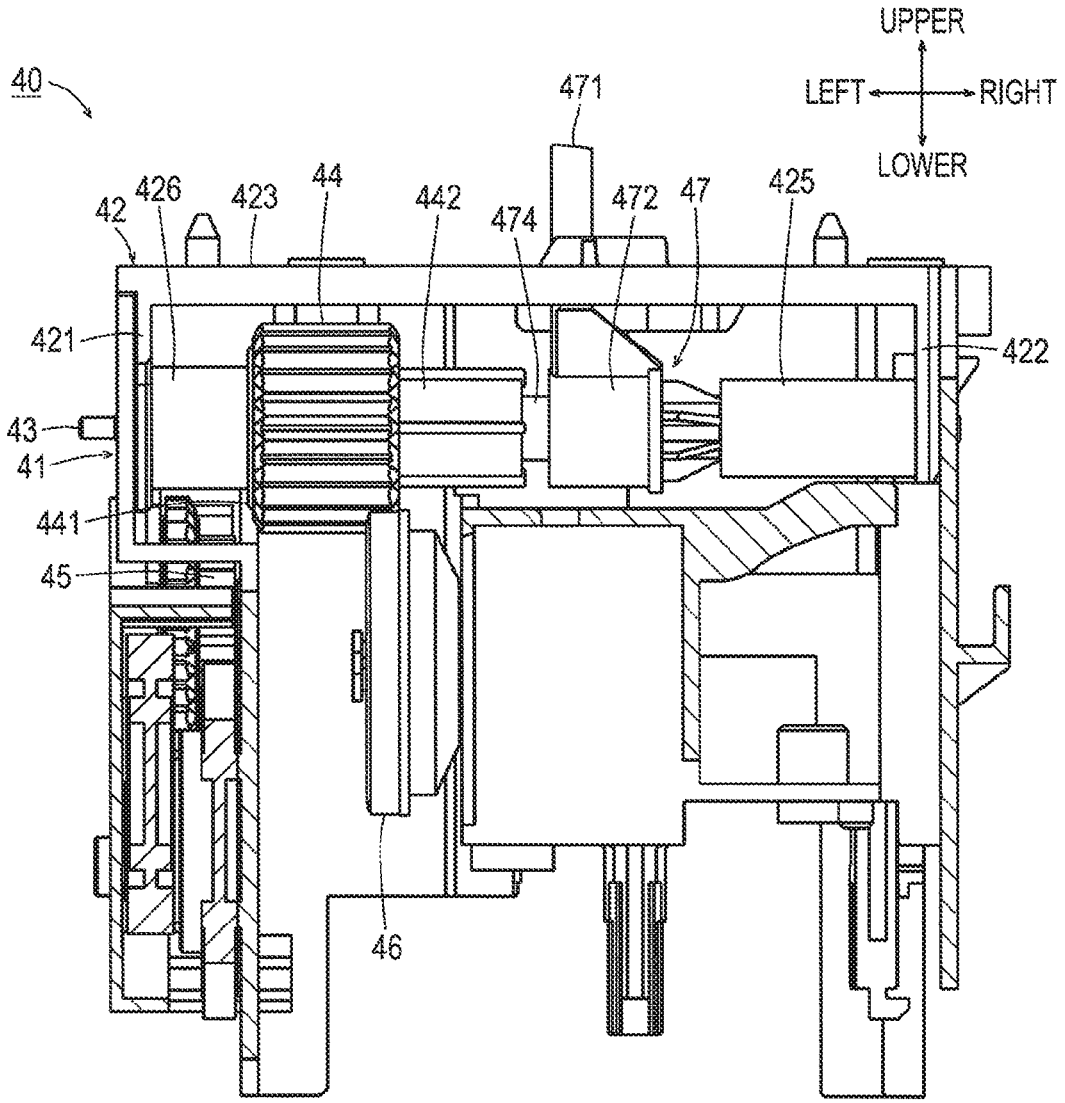
FIG. 8 is a cross-sectional view taken along line VIII-VIII in FIG. 7.

The driving transmission switch mechanism 40 further includes a slide member 47 having a lever arm 471 protruding toward the moving area of the carriage 22. The slide member 47 is located at the right side of the switch gear 44 and supported slidably by the shaft 43. The slide member 47 slides interlockingly with the reciprocating movement of the carriage 22. The slide member 47 slides between a first position (shown in FIG. 5) and a second position (shown in FIG. 8) at the right side of the first position, thereby allowing the switch gear 44 to move to two slide positions at which the switch gear 44 engages either one of the transmission gears 45, 46.

The driving force of the motor M is input to a drive roller 19 (refer to FIG. 1) of the pair of conveyance rollers 17. At the right end of the drive roller 19, a driving gear (now shown) is provided so as to rotate coaxially and integrally with the drive roller 19. In other words, the driving gear rotates about a rotation axis of the drive roller 19. The switch gear 44 (shown in FIG. 3) engages this driving gear and the switch gear 44 is driven to rotate by the output of the motor M.

Each of the transmission gears 45, 46 is configured to rotate independently. Due to sliding movement of the switch gear 44, engagement of the switch gear 44 with each of the transmission gears 45, 46 is selected. In this embodiment, the transmission gear 45 transmits the driving force of the motor M to the feed roller 13. The transmission gear 46 transmits the driving force of the motor M to the purge mechanism 34.

In this way, the driving force of the motor M is transmitted to each drive target through either one of the transmission gears 45, 46. The feed roller 13 and the purge mechanism 34 are examples of the drive target. The driving transmission switch mechanism 40 may include other transmission gears in addition to the two transmission gears 45, 46. For instance, a printer having a lower tray and a re-conveyance path (another conveyance path) may be provided with two more transmission gears at particular positions, in addition to the transmission gears 45, 46.

As shown in FIGS. 3 to 6, the slide member 47 has a cylindrical portion 472 externally fitted to the shaft 43 and a lever arm 471 protruding upward from the cylindrical portion 472. In this embodiment, the slide member 47 is an integrally molded product, but the slide member 47 may be formed from a plurality of parts. The cylindrical portion 472 externally fitted to the shaft 43 is slidable in the axial direction and rotatable about the shaft 43. In other words, the lever arm 471 is configured to slide in the axial direction of the shaft 43 and to rotate about the shaft 43.

Figure 6:
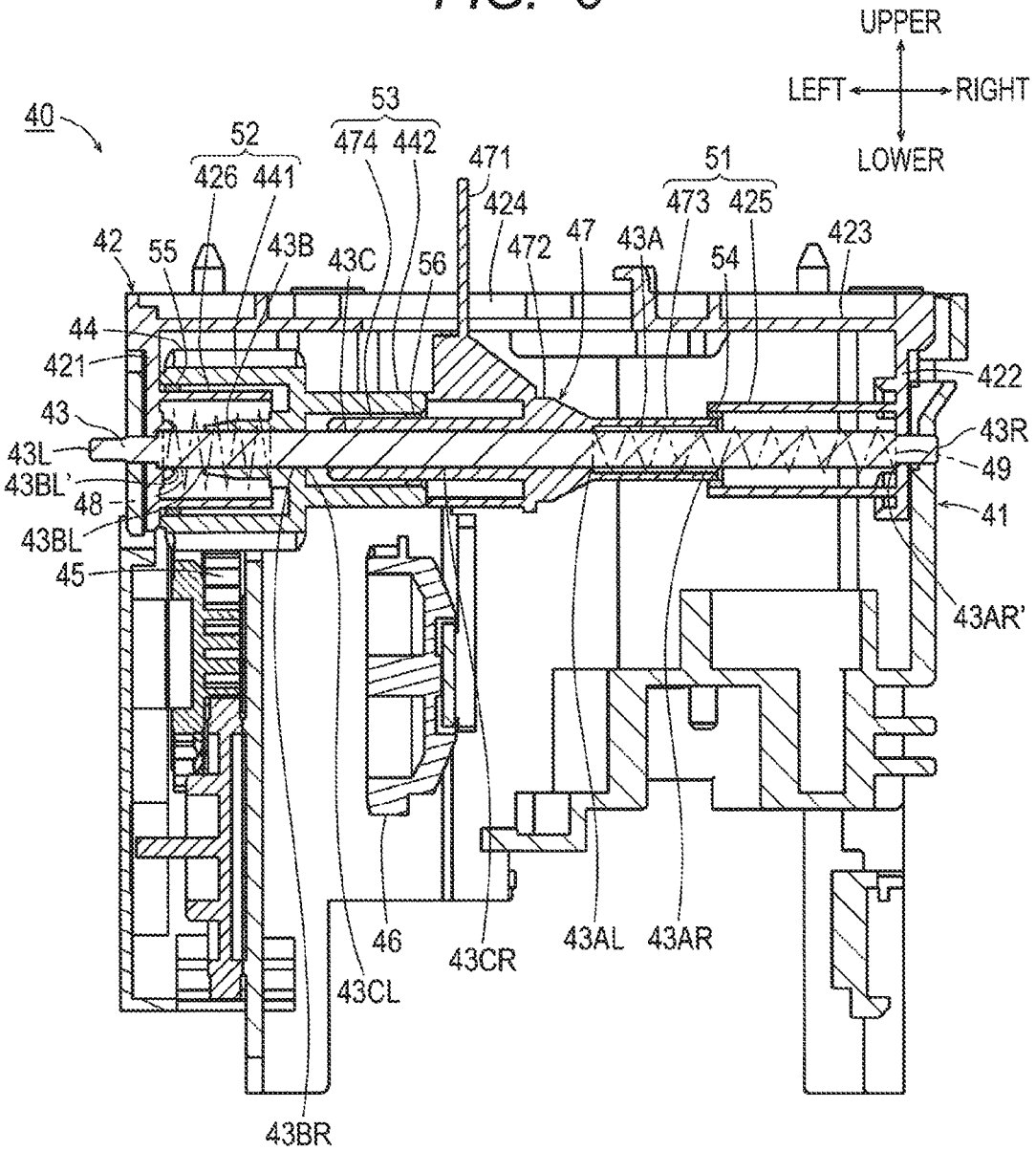
FIG. 6 is a cross-sectional view taken along line VI-VI in FIG. 4.
Figure 7:
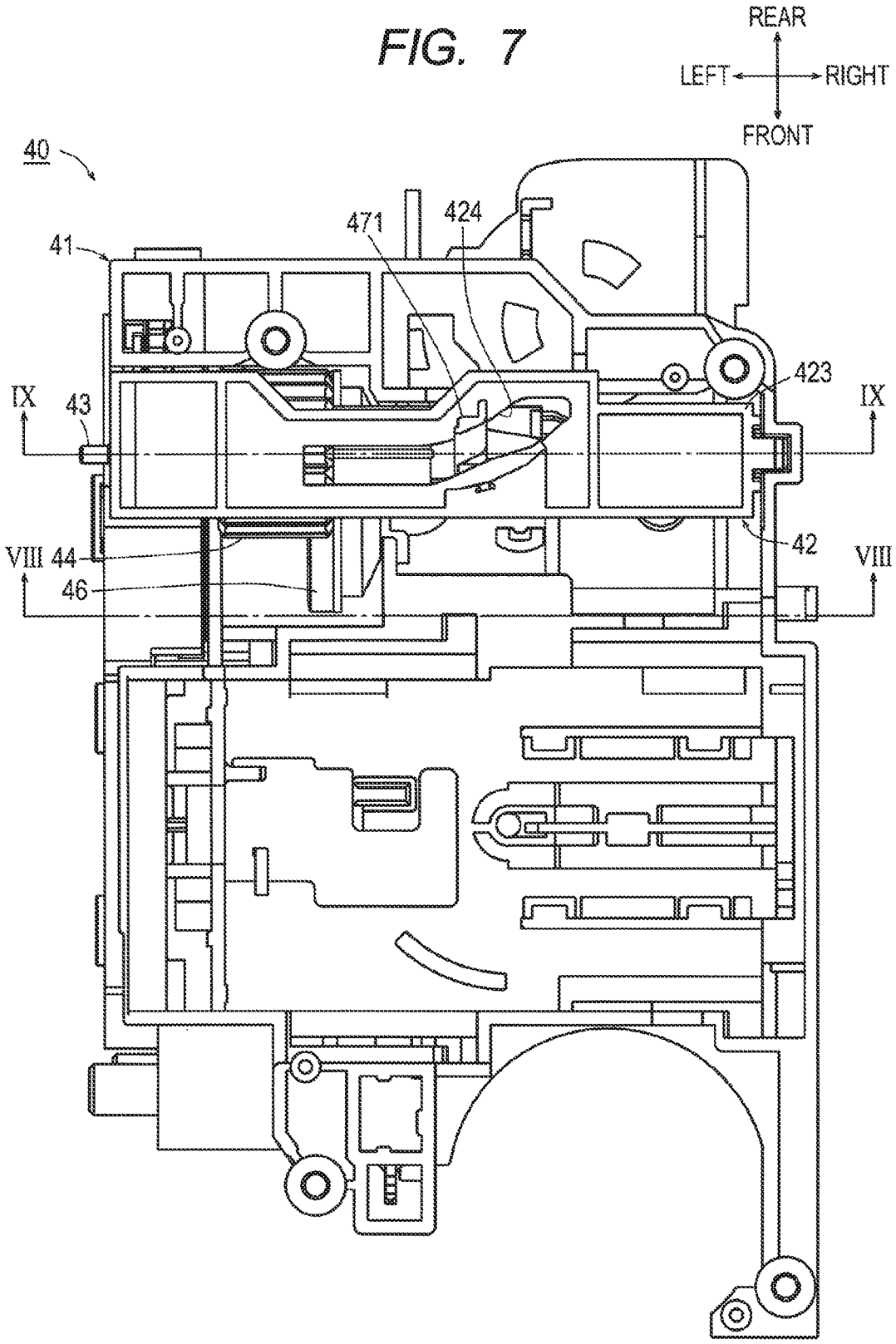
FIG. 7 is a plan view of the driving transmission switch mechanism in a state where the slide member is located at a second position.

As shown in FIG. 6, the switch gear 44 is urged elastically toward the slide member 47 by a coil spring 48 externally fitted to the shaft 43 and is configured to extend and contract in the axial direction. The slide member 47 is urged elastically toward the switch gear 44 by another coil spring 49 externally fitted to the shaft 43 and is configured to extend and contract in the axial direction. With this configuration, the switch gear 44 and the slide member 47 are caused to contact each other on the shaft 43 and thereby move together. The urging force of the coil spring 49 is larger than that of the coil spring 48. Accordingly, the switch gear 44 and the slide member 47 slide leftward unless an external force is applied, and thereby the switch gear 44 contacts a left side portion 421 of the frame 42 and the slide member 47 is located at the first position where the slide member 47 contacts the switch gear 44.

As shown in FIG. 3, the frame 42 is assembled with the upper end portion of the rear part of the frame 41. The frame 42 includes the left side portion 421 supporting the left end of the shaft 43, a right side portion 422 supporting the right end of the shaft 43, and an upper portion 423 connecting the upper end of the left side portion 421 and the upper end of the right side portion 422. The left side portion 421 and the right side portion 422 are spaced from each other in the main scanning direction (the left-right direction). The upper portion 423 is fixed to the guide rail 23.

A guide hole 424 for guiding the lever arm 471 is formed in the upper portion 423. The guide hole 424 is a long hole in the main scanning direction and the lever arm 471 is inserted therethrough. The lever arm 471 inserted in the guide hole 424 protrudes to the upper side of the guide rail 23 through a hole 231 (refer to FIG. 2) of the guide rail 23 over the guide hole 424.

As shown in FIG. 2, a guide piece 38 protruding upstream in the conveyance direction is provided at the upstream end of the carriage 22 in the conveyance direction. The guide piece 38 reciprocates together with the carriage 22. When the guide piece 38 moves rightward together with the carriage 22, the guide piece 38 contacts the lever arm 471, then the slide member 47 together with the lever arm 471 slides rightward from the first position (refer to FIG. 6) and moves to the second position (refer to FIG. 9). At this time, the switch gear 44 slides rightward from the position engaging the transmission gear 45 (refer to FIG. 6) by being urged by the coil spring 48, and moves to the position engaging the transmission gear 46 (refer to FIG. 9).

<Configuration for Suppressing Adherence of Foreign Matter to Shaft>

As shown in FIG. 6, the driving transmission switch mechanism 40 includes a first cover 51, a second cover 52, and a third cover 53, as the configuration for suppressing adherence, to the shaft 43, of foreign matters such as dusts that have entered from outside the printer 10.

<First Cover>

The first cover 51 is configured to, when the slide member 47 slides between the first position and the second position, cover an entire circumference of a first sliding contact portion 43A of the shaft 43. The first sliding contact portion 43A is a portion in sliding contact with the slide member 47 at the right side of the slide member 47 located at the first position. That is, the first sliding contact portion 43A is a portion between a left end 43AL and a right end 43AR. The first sliding contact portion 43A may include a portion (between 43AR and 43AR') that is not contacted by the slide member 47 and that is adjacent to the contacted portion (between 43AL and 43AR). In this case, the first sliding contact portion 43A is a portion between the left end 43AL and a right end 43AR'.

The first cover 51 includes a first cover member 473 and a second cover member 425. The first cover member 473 is a cylindrical member extending rightward from the right end portion of the cylindrical portion 472 of the slide member 47 so as to have a gap in which the shaft 43 and the coil spring 49 are inserted. In the present embodiment, the first cover member 473 is integrally molded with the slide member 47. Alternatively, the separate first cover member 473 may be assembled with the slide member 47.

The second cover member 425 is a cylindrical member extending leftward from the right side portion 422 of the frame 42 so as to overlap the outer circumferential surface of the first cover member 473 with a gap therebetween. In the present embodiment, the second cover member 425 is integrally molded with the frame 42. Alternatively, the separate second cover member 425 may be assembled with the frame 42.

A first seal member 54 is provided on the inner circumferential surface at the left end portion of the second cover member 425 for reducing a gap between the first cover member 473 and the second cover member 425. The first seal member 54 blocks foreign matters such as dusts and may be a ring-shaped brush or spatula, for example.

Figure 9:
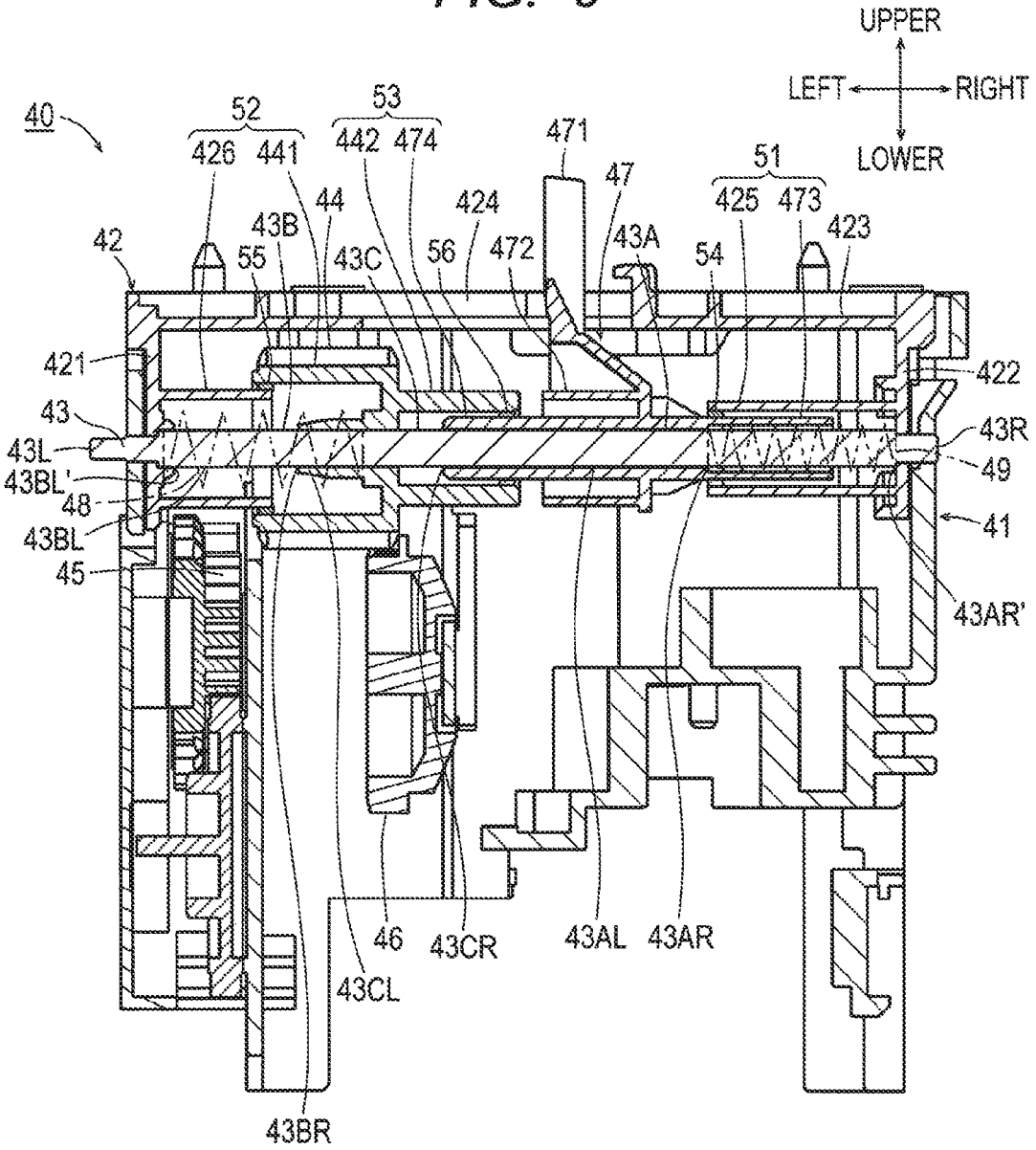
FIG. 9 is a cross-sectional view taken along line IX-IX in FIG. 7.

The first cover 51 covers the entire circumference of the first sliding contact portion 43A of the shaft 43 in both the case where the slide member 47 is located at the first position as shown in FIG. 6 and the case where the slide member 47 is located at the second position as shown in FIG. 9. This suppresses adherence to the first sliding contact portion 43A by foreign matters such as dusts having entered from outside the printer 10. This suppresses an increase of sliding resistance of the slide member 47 due to adherence of foreign matters, and suppresses heat generation and so on due to a switching malfunction of the switch gear 44 and a load increase of the motor M.

By forming the first cover 51 with the first cover member 473 and the second cover member 425, the shaft 43 is shortened by the overlap length between the first cover member 473 and the second cover member 425, and the length of the driving transmission switch mechanism 40 in the main scanning direction is shortened.

Alternatively, the second cover member 425 and the first cover member 473 may overlap each other such that the second cover member 425 is on the inner side and the first cover member 473 is on the outer side. The first cover 51 does not necessarily need to cover an entire circumference of the first sliding contact portion 43A as long as the first cover 51 covers an entire range of the first sliding contact portion 43A in the main scanning direction. For example, the first cover 51 may be a half cylindrical shaped member covering the upper side of the first sliding contact portion 43A.

The first cover 51 may be formed with a single member. For example, the first cover member 473 may be formed longer such that the first cover member 473 by itself covers the first sliding contact portion 43A. In this case, the frame 42 and the shaft 43 need to be extended such that the first cover member 473 does not interfere with the right side portion 422 of the frame 42. For example, an extendable cover member such as an accordion-like structure may be adopted, and both end portions thereof may be fixed to the slide member 47 and the right side portion 422.

<Second Cover>

The second cover 52 is configured to, when the switch gear 44 slides, cover an entire circumference of a second sliding contact portion 43B of the shaft 43. The second sliding contact portion 43B is a portion in sliding contact with the switch gear 44 at the left side of the switch gear 44 located at the right side slide position shown in FIG. 9. That is, the second sliding contact portion 43B is a portion between a left end 43BL and a right end 43BR. The second sliding contact portion 43B may include a portion (between 43BL' and 43BL) that is not contacted by the switch gear 44 and that is adjacent to the contacted portion (between 43BL and 43BR). In this case, the second sliding contact portion 43B is a portion between a left end 43BL' and the right end 43BR.

The second cover 52 includes a third cover member 441 and a fourth cover member 426. The third cover member 441 is a cylindrical member formed on the inner circumference of the gear portion of the switch gear 44. The third cover member 441 may be a cylindrical member extending leftward from the left end portion of the switch gear 44. In the present embodiment, the third cover member 441 is integrally molded with the switch gear 44. Alternatively, the separate third cover member 441 may be assembled with the switch gear 44.

The fourth cover member 426 is a cylindrical member extending rightward from the left side portion 421 of the frame 42 so as to have a gap in which the shaft 43 and the coil spring 48 are inserted and so as to overlap the inner circumferential surface of the third cover member 441 with a gap therebetween. In the present embodiment, the fourth cover member 426 is integrally molded with the frame 42. Alternatively, the separate fourth cover member 426 may be assembled with the frame 42.

A second seal member 55 is provided on the inner circumferential surface at the left end portion of the third cover member 441 for reducing a gap between the third cover member 441 and the fourth cover member 426. Like the first seal member 54, the second seal member 55 blocks foreign matters such as dusts and may be a ring-shaped brush or spatula, for example.

The second cover 52 covers the entire circumference of the second sliding contact portion 43B of the shaft 43 in both the case where the switch gear 44 is located at the left side slide position as shown in FIG. 6 and the case where the switch gear 44 is located at the right side slide position as shown in FIG. 9. This suppresses adherence to the second sliding contact portion 43B by foreign matters such as dusts having entered from outside the printer 10. This suppresses an increase of sliding resistance of the switch gear 44 due to adherence of foreign matters, and suppresses heat generation and so on due to a switching malfunction of the switch gear 44 and a load increase of the motor M.

By forming the second cover 52 with the third cover member 441 and the fourth cover member 426, the shaft 43 is shortened by the overlap length between the third cover member 441 and the fourth cover member 426, and the length of the driving transmission switch mechanism 40 in the main scanning direction is shortened.

Alternatively, the third cover member 441 and the fourth cover member 426 may overlap each other such that the third cover member 441 is on the inner side and the fourth cover member 426 is on the outer side. The second cover 52 does not necessarily need to cover an entire circumference of the second sliding contact portion 43B as long as the second cover 52 covers an entire range of the second sliding contact portion 43B in the main scanning direction. For example, the second cover 52 may be a half cylindrical shaped member covering the upper side of the second sliding contact portion 43B.

The second cover 52 may be formed with a single member. For example, the third cover member 441 may be formed longer such that the third cover member 441 by itself covers the second sliding contact portion 43B. In this case, the frame 42 and the shaft 43 need to be extended such that the third cover member 441 does not interfere with the left side portion 421 of the frame 42. For example, an extendable cover member such as an accordion-like structure may be adopted, and both end portions thereof may be fixed to the switch gear 44 and the left side portion 421.

<Third Cover>

The third cover 53 is configured to cover an entire circumference of the third sliding contact portion 43C of the shaft 43 between the slide member 47 and the switch gear 44 when the slide member 47 slides between the first position and the second position. That is, the third sliding contact portion 43C is a portion between a left end 43CL and a right end 43CR. The third sliding contact portion 43C may include a portion that is not contacted by the switch gear 44 or the slide member 47 and that is adjacent to the portion contacted by the switch gear 44 or the slide member 47.

The third cover 53 includes a fifth cover member 474 and a sixth cover member 442. The fifth cover member 474 is a cylindrical member extending leftward from the left end portion of the cylindrical portion 472 of the slide member 47 so as to fit the outside of the shaft 43. The fifth cover member 474 may be a cylindrical member extending leftward from the left end portion of the cylindrical portion 472 of the slide member 47 so as to have a gap between the shaft 43 and the fifth cover member 474. In the present embodiment, the fifth cover member 474 is integrally molded with the slide member 47. Alternatively, the separate fifth cover member 474 may be assembled with the slide member 47.

The sixth cover member 442 is a cylindrical member extending rightward from the right end portion of the switch gear 44 so as to overlap the outer circumferential surface of the fifth cover member 474 with a gap therebetween. In the present embodiment, the sixth cover member 442 is integrally molded with the switch gear 44. Alternatively, the separate sixth cover member 442 may be assembled with the switch gear 44.

A third seal member 56 is provided on the inner circumferential surface at the right end portion of the sixth cover member 442 for reducing a gap between the fifth cover member 474 and the sixth cover member 442. Like the first seal member 54, the third seal member 56 blocks foreign matters such as dusts and may be a ring-shaped brush or spatula, for example.

The third cover 53 covers the entire circumference of the third sliding contact portion 43C of the shaft 43 in both the case where the slide member 47 is located at the first position as shown in FIG. 6 and the case where the slide member 47 is located at the second position as shown in FIG. 9. This suppresses adherence to the third sliding contact portion 43C by foreign matters such as dusts having entered from outside the printer 10. This suppresses an increase of sliding resistance of the slide member 47 due to adherence of foreign matters, and suppresses heat generation and so on due to a switching malfunction of the switch gear 44 and a load increase of the motor M.

By forming the third cover 53 with the fifth cover member 474 and the sixth cover member 442, the shaft 43 is shortened by the overlap length between the fifth cover member 474 and the sixth cover member 442, and the length of the driving transmission switch mechanism 40 in the main scanning direction is shortened.

Alternatively, the sixth cover member 442 and the fifth cover member 474 may overlap each other such that the sixth cover member 442 is on the inner side and the fifth cover member 474 is on the outer side. The third cover 53 does not necessarily need to cover an entire circumference of the third sliding contact portion 43C as long as the third cover 53 covers an entire range of the third sliding contact portion 43C in the main scanning direction. For example, the third cover 53 may be a half cylindrical shaped member covering the upper side of the third sliding contact portion 43C.

The third cover 53 may be formed with a single member. For example, the sixth cover member 442 may be formed longer such that the sixth cover member 442 by itself covers the third sliding contact portion 43C. In this case, the frame 42 and the shaft 43 need to be extended such that the sixth cover member 442 does not interfere with the slide member 47. For example, an extendable cover member such as an accordion-like structure may be adopted, and both end portions thereof may be fixed to the slide member 47 and the switch gear 44.

[Modification]

While the disclosure has been described in detail with reference to the above aspects thereof, it would be apparent to those skilled in the art that various changes and modifications may be made therein without departing from the scope of the claims.

Figure 10:
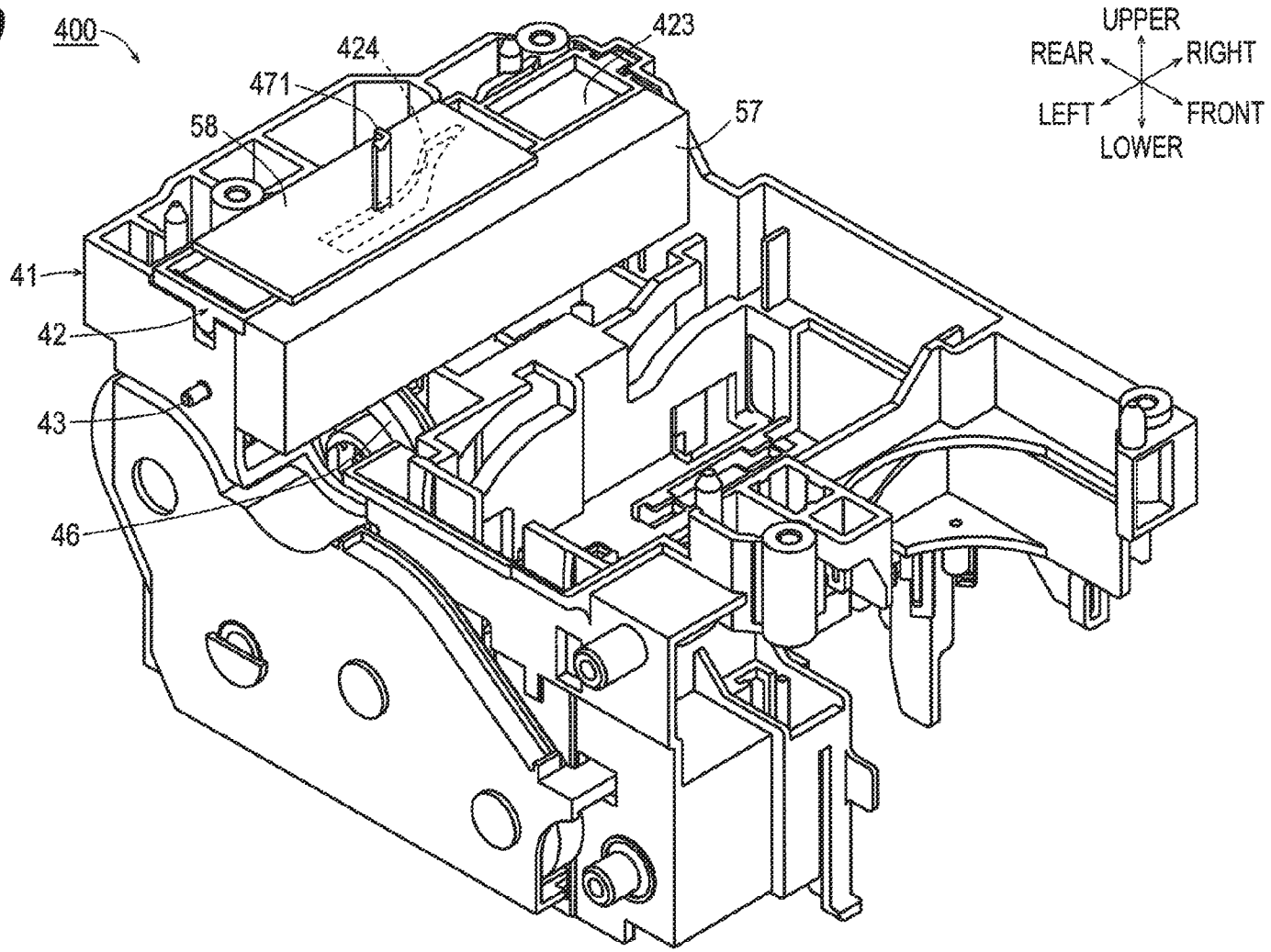
FIG. 10 is a perspective view of a driving transmission switch mechanism according to a modification.

A driving transmission switch mechanism 400 according to a modification will be described while referring to FIG. 10. The driving transmission switch mechanism 400 is different from the driving transmission switch mechanism 40 described above in that the driving transmission switch mechanism 400 includes a wall 57 and a fourth cover 58, and the other configurations thereof are the same as those of the driving transmission switch mechanism 40. Thus, like parts and components are designated by the same reference numerals to avoid duplicating description.

The wall 57 is a plate-shaped member extending from the front end portion of the frame 42 to a position lower than the shaft 43. The front side of the shaft 43 is covered by providing the wall 57, which improves the effect of blocking foreign matters from the front of the shaft 43. Alternatively, the wall 57 may be provided at the rear end side of the frame 42. This configuration improves the effect of blocking foreign matters from the rear of the shaft 43.

The fourth cover 58 is provided at the slide member 47 and configured to cover the guide hole 424 when the slide member 47 is located at the first position and at the second position. In the present embodiment, the fourth cover 58 is a rectangular plate-shaped member fixed to the lever arm 471 so as to be perpendicular to the lever arm 471 at a part of the lever arm 471 protruding upward from the guide hole 424. Alternatively, the fourth cover 58 may be provided at a part of the lever arm 471 protruding downward from the guide hole 424. The shape of the fourth cover 58 is not limited to a particular shape, and any shape may be adopted as long as the fourth cover 58 covers the guide hole 424 when the slide member 47 is located at the first position and at the second position.

In this way, the upper side of the guide hole 424 is covered by providing the fourth cover 58, thereby suppressing entrance of foreign matters through the guide hole 424 and improving the effect of blocking foreign matters from the upper side of the shaft 43.

[Effects of Embodiment]

The printer 10 of the above-described embodiment includes the carriage 22 supporting the recording head 21 and configured to reciprocate in the main scanning direction including the first direction and the second direction opposite the first direction, the motor M, and the driving transmission switch mechanism 40 configured to transmit driving force of the motor M while selectively switching the plurality of drive targets. The driving transmission switch mechanism 40 includes the frame 42, the shaft 43 supported by the frame 42 and extending in the main scanning direction, and the switch gear 44 slidably supported by the shaft 43 and configured to rotate by driving force of the motor M. The driving transmission switch mechanism 40 further includes the plurality of transmission gears 45, 46 arranged at positions corresponding to the slide position of the switch gear 44 in the main scanning direction and configured to engage the switch gear 44 to transmit driving force to the plurality of drive targets. The driving transmission switch mechanism 40 further includes the slide member 47 having the lever arm 471 protruding to the movement region of the carriage 22, the slide member 47 being slidably supported by the shaft 43 at the first end side (the right end side) of the switch gear 44 (that is, the slide member 47 is closer to the right end 43R than the switch gear 44 is) to slide in conjunction with reciprocation of the carriage 22, the slide member 47 being configured to slide between the first position and the second position at the first end side (the right end side) of the first position, thereby allowing the switch gear 44 to move to the plurality of slide positions at which the switch gear 44 engages one of the plurality of transmission gears 45, 46. The driving transmission switch mechanism 40 further includes the first cover 51 configured to, when the slide member 47 slides between the first position and the second position, cover the first sliding contact portion 43A of the shaft 43 over an entire range of the first sliding contact portion 43A in the main scanning direction, the first sliding contact portion 43A being in sliding contact with the slide member 47 at the first end side (the right end side) of the slide member 47 located at the first position.

With this configuration, the first cover 51 covers the first sliding contact portion 43A of the shaft 43 over an entire range of the first sliding contact portion 43A in the main scanning direction, thereby suppressing adherence of foreign matters to the first sliding contact portion 43A. This suppresses an increase of sliding resistance of the slide member 47 due to adherence of foreign matters, and suppresses heat generation and so on due to a switching malfunction of the switch gear 44 and a load increase of the motor M.

According to the printer 10 of the above-described embodiment, the first cover 51 covers the entire circumference of the first sliding contact portion 43A of the shaft 43.

This configuration improves the effect of blocking foreign matters.

According to the printer 10 of the above-described embodiment, the first cover 51 includes the first cover member 473 extending from the slide member 47 in the first direction and the second cover member 425 extending from the frame 42 in the second direction so as to overlap the first cover member 473.

With this configuration, the shaft 43 can be shortened by the overlap length between the first cover member 473 and the second cover member 425, and the length of the driving transmission switch mechanism 40 in the main scanning direction can be shortened.

According to the printer 10 of the above-described embodiment, the first seal member 54 for reducing a gap is provided at the gap between the first cover member 473 and the second cover member 425.

With this configuration, entrance of foreign matters through a gap between the first cover member 473 and the second cover member 425 can be suppressed.

According to the printer 10 of the above-described embodiment, the driving transmission switch mechanism 40 includes the second cover 52 configured to, when the switch gear 44 slides to the plurality of slide positions, cover the second sliding contact portion 43B of the shaft 43 over an entire range of the second sliding contact portion 43B in the main scanning direction, the second sliding contact portion 43B being in sliding contact with the switch gear 44 at the second end side (the left end side) of the switch gear 44 located at the slide position at the farthest side in the first direction among the plurality of slide positions.

With this configuration, the second cover 52 covers the second sliding contact portion 43B of the shaft 43 over an entire range of the second sliding contact portion 43B in the main scanning direction, thereby suppressing adherence of foreign matters to the second sliding contact portion 43B. This further suppresses adherence of foreign matters to the shaft 43.

According to the printer 10 of the above-described embodiment, the second cover 52 covers the entire circumference of the second sliding contact portion 43B of the shaft 43.

This configuration improves the effect of blocking foreign matters.

According to the printer 10 of the above-described embodiment, the second cover 52 includes the third cover member 441 extending from the switch gear 44 in the second direction and the fourth cover member 426 extending from the frame 42 in the first direction so as to overlap the third cover member 441.

With this configuration, the shaft 43 can be shortened by the overlap length between the third cover member 441 and the fourth cover member 426, and the length of the driving transmission switch mechanism 40 in the main scanning direction can be shortened.

According to the printer 10 of the above-described embodiment, the second seal member 55 for reducing a gap is provided at the gap between the third cover member 441 and the fourth cover member 426.

With this configuration, entrance of foreign matters through a gap between the third cover member 441 and the fourth cover member 426 can be suppressed.

According to the printer 10 of the above-described embodiment, the driving transmission switch mechanism 40 includes the third cover 53 configured to, when the slide member 47 slides between the first position and the second position, cover the third sliding contact portion 43C of the shaft 43 between the slide member 47 and the switch gear 44 over an entire range of the third sliding contact portion 43C in the main scanning direction.

With this configuration, the third cover 53 covers the third sliding contact portion 43C of the shaft 43 over an entire range of the third sliding contact portion 43C in the main scanning direction, thereby suppressing adherence of foreign matters to the third sliding contact portion 43C. This further suppresses adherence of foreign matters to the shaft 43.

According to the printer 10 of the above-described embodiment, the third cover 53 covers the entire circumference of the third sliding contact portion 43C of the shaft 43.

This configuration improves the effect of blocking foreign matters.

According to the printer 10 of the above-described embodiment, the third cover 53 includes the fifth cover member 474 extending from the slide member 47 in the second direction and the sixth cover member 442 extending from the switch gear 44 in the first direction so as to overlap the fifth cover member 474.

With this configuration, the shaft 43 can be shortened by the overlap length between the fifth cover member 474 and the sixth cover member 442, and the length of the driving transmission switch mechanism 40 in the main scanning direction can be shortened.

The printer 10 of the above-described embodiment is provided with a third seal member 56 that reduces a gap between the fifth cover member 474 and the sixth cover member 442.

With this configuration, entrance of foreign matters through a gap between the fifth cover member 474 and the sixth cover member 442 can be suppressed.

The printer 10 of the above-described modification is provided with the wall 57 that extends from the end portion of the frame 42 in the sub-scanning direction perpendicular to the main scanning direction to a position lower than the shaft 43.

This configuration improves the effect of blocking foreign matters relative to the shaft 43.

According to the printer 10 of the above-described modification, the frame 42 has the guide hole 424 that guides the lever arm 471, and the slide member 47 has the fourth cover 58 that covers the guide hole 424 at the first position and at the second position.

With this configuration, entrance of foreign matters through the guide hole 424 can be suppressed.

What is claimed is:

1. An image recording apparatus comprising:

a carriage supporting a recording head, the carriage being configured to reciprocate in a main scanning direction;

a motor; and a driving transmission switch mechanism configured to switch between a plurality of drive targets and to selectively transmit driving force of the motor to one of the plurality of drive targets, the driving transmission switch mechanism including:

a frame;

a shaft supported by the frame and extending in the main scanning direction, the shaft having a first end and a second end opposite the first end in the main scanning direction;

a switch gear slidably supported by the shaft and configured to rotate by receiving driving force of the motor;

a plurality of transmission gears arranged at positions in the main scanning direction corresponding to a plurality of slide positions of the switch gear, each of the plurality of transmission gears being configured to engage the switch gear and to transmit a driving force to a corresponding one of the plurality of drive targets;

a slide member including a lever arm protruding to a movement region of the carriage, the slide member being slidably supported by the shaft, the slide member being closer to the first end than the switch gear is, the slide member being configured to slide in conjunction with reciprocation of the carriage, the slide member being configured to slide between a first position and a second position to cause the switch gear to move between the plurality of slide positions at which the switch gear engages respective ones of the plurality of transmission gears, the slide member located at the second position being closer to the first end than the slide member located at the first position is; and a first cover configured to cover a first sliding contact portion of the shaft over an entire range of the first sliding contact portion in the main scanning direction, the first sliding contact portion being a part of a surface of the shaft, the slide member being in sliding contact with the first sliding contact portion when the slide member slides between the first position and the second position, the first sliding contact portion being closer to the first end than the slide member located at the first position is.

2. The image recording apparatus according to claim 1, wherein the first cover covers an entire circumference of the first sliding contact portion.

3. The image recording apparatus according to claim 1, wherein the frame has a first side portion and a second side portion spaced from each other in the main scanning direction, the first side portion supporting the first end of the shaft, the second side portion supporting the second end of the shaft; and wherein the first cover includes:

a first cover member extending toward the first end from the slide member; and a second cover member extending toward the second end from the first end so as to overlap the first cover member.

4. The image recording apparatus according to claim 3, wherein the driving transmission switch mechanism further includes a seal member provided at a gap between the first cover member and the second cover member so as to reduce the gap.

5. The image recording apparatus according to claim 1, wherein the driving transmission switch mechanism further includes a second cover configured to cover a second sliding contact portion of the shaft over an entire range of the second sliding contact portion in the main scanning direction, the switch gear being in sliding contact with the second sliding contact portion when the switch gear slides between the plurality of slide positions, the second sliding contact portion being closer to the second end than the switch gear located at a slide position that is closest to the first end among the plurality of slide positions.

6. The image recording apparatus according to claim 5, wherein the second cover covers an entire circumference of the second sliding contact portion.

7. The image recording apparatus according to claim 5, wherein the frame has a first side portion and a second side portion spaced from each other in the main scanning direction, the first side portion supporting the first end of the shaft, the second side portion supporting the second end of the shaft; and wherein the second cover includes:

a first cover member extending toward the second end from the switch gear; and a second cover member extending toward the first end from the second side portion so as to overlap the first cover member.

8. The image recording apparatus according to claim 7, wherein the driving transmission switch mechanism further includes a seal member provided at a gap between the first cover member and the fourth cover member so as to reduce the gap.

9. The image recording apparatus according to claim 1, wherein the driving transmission switch mechanism further includes a second cover configured to cover a second sliding contact portion of the shaft over an entire range of the second sliding contact portion in the main scanning direction, the second sliding contact portion being located between the slide member and the switch gear when the slide member slides between the first position and the second position.

10. The image recording apparatus according to claim 9, wherein the second cover covers an entire circumference of the second sliding contact portion.

11. The image recording apparatus according to claim 9, wherein the second cover includes:

a first cover member extending toward the second end from the slide member; and a second cover member extending toward the first end from the switch gear so as to overlap the first cover member.

12. The image recording apparatus according to claim 11, wherein the driving transmission switch mechanism further includes a seal member provided at a gap between the first cover member and the second cover member so as to reduce the gap.

13. The image recording apparatus according to claim 1, wherein the driving transmission switch mechanism further includes a wall extending from an end of the frame in a sub-scanning direction to a lower position than the shaft, the sub-scanning direction being perpendicular to the main scanning direction.

14. The image recording apparatus according to claim 1, wherein the frame is formed with a guide hole configured to guide the lever arm; and wherein the slide member further includes a second cover configured to cover the guide hole in a state where the slide member is located at the first position and in a state where the slide member is located at the second position.

15. The image recording apparatus according to claim 1, wherein the frame has a first side portion and a second side portion spaced from each other in the main scanning direction, the first side portion supporting the first end of the shaft, the second side portion supporting the second end of the shaft;

wherein the driving transmission switch mechanism further includes:

a first spring provided on the shaft between the second side portion and the switch gear so as to urge the switch gear toward the slide member; and a second spring provided on the shaft between the first side portion and the slide member so as to urge the slide member toward the switch gear, thereby causing the switch gear and the slide member to contact each other and to move together;

wherein urging force of the second spring is larger than urging force of the first spring, which, in a state where no external force is applied, causes the switch gear and the slide member to slide toward the second end such that the switch gear engages a first transmission gear, the first transmission gear being one of the plurality of transmission gears; and wherein, when the carriage pushes the lever arm in a direction from the second end toward the first end, the slide member and the switch gear slide toward the first end such that the switch gear engages a second transmission gear, the second transmission gear being one of the plurality of transmission gears and being located closer to the first end than the first transmission gear is.

* * * * *